US011389355B2

(12) United States Patent
Maindal et al.

(10) Patent No.: US 11,389,355 B2
(45) Date of Patent: Jul. 19, 2022

(54) GUARD RAIL FOR A BED, GUIDE RACK FOR A GUARD RAIL AND A BED WITH SUCH GUARD RAIL

(71) Applicant: Vendlet ApS, Aabenraa (DK)

(72) Inventors: Peter Maindal, Aabenraa (DK); Søren Hedegaard Matthesen, Vejle Ø (DK); Brian Kold Mundeling, Aabenraa (DK)

(73) Assignee: Vendlet ApS, Aabenraa (DK)

( * ) Notice: Subject to any disclaimer, the term of this patent is extended or adjusted under 35 U.S.C. 154(b) by 0 days.

(21) Appl. No.: 16/760,085

(22) PCT Filed: Oct. 12, 2018

(86) PCT No.: PCT/DK2018/050255

§ 371 (c)(1),
(2) Date: Apr. 29, 2020

(87) PCT Pub. No.: WO2019/086085

PCT Pub. Date: May 9, 2019

(65) Prior Publication Data

US 2021/0236360 A1 Aug. 5, 2021

(30) Foreign Application Priority Data

Oct. 30, 2017 (DK) ..... PA 2017 70812

(51) Int. Cl.

| | |
|---|---|
| ***A61G 7/05*** | (2006.01) |
| ***A47C 21/08*** | (2006.01) |
| ***A61G 7/00*** | (2006.01) |

(52) U.S. Cl.

CPC ..... *A61G 7/0516* (2016.11); *A47C 21/08* (2013.01); *A61G 7/001* (2013.01)

(58) Field of Classification Search

CPC ..... A47D 7/005; A47D 7/02; A47D 13/065; A61G 7/0516; A61G 7/001; A47C 21/08

See application file for complete search history.

(56) References Cited

U.S. PATENT DOCUMENTS

| | | | |
|---|---|---|---|
| 3,248,743 | A | 5/1966 | Auten |
| 2004/0211002 | A1 | 10/2004 | Tomas |
| 2010/0000018 | A1 | 1/2010 | Eleonori |

FOREIGN PATENT DOCUMENTS

| | | | |
|---|---|---|---|
| BE | 873880 | A | 8/1979 |
| CN | 101605577 | A | 12/2009 |

(Continued)

*Primary Examiner* — Peter M. Cuomo
*Assistant Examiner* — Adam C Ortiz
(74) *Attorney, Agent, or Firm* — James Creighton Wray

(57) ABSTRACT

Guard rail for a bed, guide rack for a guard rail and a bed with such guard rail The invention relates to a guard rail with bars intended for extending along a side of the bed. Guide racks are arranged along opposing ends of the bars. The guide racks include fastening means for securing the guide racks to the bed. Each end of the bars is adapted for engaging a suspension element. Each of the guide racks has a hook at a top position of the guide rack. A top suspension element has a pawl capable of engaging and disengaging the hook of the guide rack. Between a top suspension element and a neighbouring lower suspension element, a connecting element is provided, having a variable extension and a maximum extension between the top suspension element and the neighbouring first lower suspension element. The invention also relates to a guide rack, a method of operating the guard rail and to a bed with a guard rail.

9 Claims, 5 Drawing Sheets

(56) References Cited

FOREIGN PATENT DOCUMENTS

| | | | | | |
|---|---|---|---|---|---|
| CN | 201728661 | A | | 2/2011 | |
| CN | 105266986 | A | | 1/2016 | |
| CN | 205649602 | U | | 10/2016 | |
| DE | 19828136 | A1 | | 1/1999 | |
| EP | 2198821 | A1 | * | 6/2010 | ..... A61G 7/0507 |
| EP | 2206486 | A2 | | 7/2010 | |
| FR | 2982750 | A1 | | 5/2013 | |
| GB | 1539234 | A | * | 1/1979 | ..... A61G 7/0515 |
| GB | 1539234 | A | | 1/1979 | |
| WO | 2006056146 | A1 | | 6/2006 | |

* cited by examiner

GUARD RAIL FOR A BED, GUIDE RACK FOR A GUARD RAIL AND A BED WITH SUCH GUARD RAIL

This application claims the benefit of Danish Application No. PA 2017 70812 filed Oct. 30, 2017 and PCT/DK2018/050255 filed Oct. 12, 2018, International Publication No. WO 2019/086085 A1, which are hereby incorporated by reference in their entirety as if fully set forth herein.

FIELD OF THE INVENTION

The present invention relates to a guard rail for a bed a with a plurality of bars intended for extending along a side of the bed, and which in the situation of use has an top bar and one or more lower bars, and where the plurality of bars has one end and another end, the other end being opposite to the one end of the bars, the one end facing one end of a bed in the situation of use and the other end facing another end of the bed in the situation of use, the other end of the bed being opposite to the one end of the bed. The invention also relates to a bed with such guard rails.

BACKGROUND OF THE INVENTION

Bed-ridden, weak and physically disadvantaged persons will often have great benefit from using a barrier at the sides of their beds such that they do not fall out therefrom. In particular dizzy persons under strong medication as well as elderly may harm themselves if they accidentally fall out of a bed. Moreover, there are certain illnesses as e.g. Huntington's Disease that imply that the patient cannot lie still, so that lateral support is required to ensure that such persons do not harm themselves. By providing the bed with a guard rail, the persons will not be able to fall out of the bed in spite of a fitful sleep.

In order to avoid the guard rail becoming a hazard for the bed-ridden person, the production of guard rails is controlled by diverse regulations, such as ICE 60601-2-52. Adjustable beds for disabled persons "Requirements and test methods" and DS/EN 1970/A1:2005 Adjustable beds for disabled persons "Requirements and test methods". These regulations describe how the guard rail is to be designed in order to be both safe and efficient in the most optimal way. This means that there are specific requirements to how large holes and gaps there may exist between the bed and the guard rail. If these holes and gaps are too large, in the worst foreseeable case it may happen that a person may get his neck squeezed between the guard rail and the bed and thereby harm himself.

Another feature of a good guard rail is that it may be operated quickly and easily so that the bedridden person can be moved from one bed to another, or so that the person may be cared for. In hospitals and nursing homes, traditionally is used a guard rail of a type with two parallel bars which by a slight pressure may be pushed down and collapsed such that the guard rail appears as an integrated lower part of the bed.

EP 2 206 486 discloses a plate element which in the situation of use has an upper, approximately horizontal edge. The plate element has a front side and a back side, the front side facing away from the bed in the situation of use. One or more largely vertically arranged telescoping cylinders are disposed in the situation of use along opposing ends of the plate element. The telescoping cylinders include fastening means for securing the telescoping cylinders to the bed. A bar which is mounted on the plate element and which at each end is adapted to engage suspension elements fastened on the telescoping cylinders. The telescopic cylinders are driven either by pneumatics, hydraulics, an electric step motor or in similar ways. In this way it becomes possible for the staff to avoid lifting or pulling for manually moving the guard rail. However, telescopic cylinders are expensive and need careful attention, when used, in order to avoid possibly applying a large force to the guard rails or to a patient entering or leaving the bed.

OBJECT OF THE INVENTION

It is an object of the invention to provide another, and easier to use, means of lifting and lowering guard rails of the type comprising bars extending along sides of a bed.

DESCRIPTION OF THE INVENTION

The object of the invention is obtained by guard rail, where each of the two guide racks has a hook at an top position of the guide rack and that a top suspension element has a pawl, which pawl, in the situation of use, engages the hook of the guide rack and that the top suspension element is capable of being released from the engagement with the hook,

- the top suspension element suspends an end of the top bar, and that the top suspension element is connected to a neighbouring first lower suspension element, which lower suspension element suspends an end of a first lower bar neighbouring the top bar, and
- connection between the top suspension element and the neighbouring first lower suspension elements is provided by a connecting element having a variable extension and a maximum extension between the top suspension element and the neighbouring first lower suspension element.

Connecting a top suspension element, by which the top rod is suspended, to a lower suspension element, to which a lower rod id suspended, has the advantage of a user only having to elevate the top rod, and the lower rods will follow automatically, due to the connection between the top suspension element and the lower suspension element.

According to a preferred embodiment of the invention, the first lower suspension element suspending an end of the first lower bar is connected to a neighbouring second lower suspension element, which second lower suspension element suspends an end of a second lower bar neighbouring the first lower bar, and

- connection between the first lower suspension element and the neighbouring second lower suspension element is provided by a connecting element having a variable extension and a maximum extension between the first lower suspension element and the neighbouring second lower suspension element.

The connection between suspension elements being variable has the advantage, that a distance between the suspension elements may vary, depending on the top rod, and thus the top suspension, being in a non-elevated position, where a distance between the rods should be relatively small, and the top rod, and thus the top suspension, being in an elevated position, where a distance between the rods should be relatively large.

According to an embodiment of the invention, the bars is telescopic along a longitudinal direction of the bars, so that a distance along a longitudinal direction of the bars is variable between the one end of each of the bars and the other opposite end of each of the bars, and so that the bars may extend horizontally and non-horizontally when being displaced vertically along between guide racks fixedly positioned at each end of a bed, which the guard rail is attached to.

Bars being telescopic provide a possibility of the bars being adjustable for attachment to beds with different lengths, but also provide a possibility of the rod extending either horizontally or extending at slight angle to horizontal, so that one end of the rod may be elevated initially and another end of the rod may be elevated subsequently.

According to an embodiment of the invention, each of opposite end of the top bar and the lower bars are attached to a suspension element via a pivot pin, and that each end of the bars, in a situation of use, where the guard rail is attached to a frame of a bed, is pivotable around a substantially horizontal axis along the pivot pin.

A pivot pin between the rods and the corresponding suspension elements of the rods provides a means for the rods to extend at various angles to horizontal, and also to extend horizontally, depending on the use and the operation of the rods by a user.

According to the invention, a guide rack is provided with a plurality of notches extending, in a situation of use, along a vertical direction and that the guide rack is provided with a vertical slot, and that each of the notches has a bottom of the notch and an opening of the notch, and that the opening of each of the notches communicates with the vertical slot, and that a pawl of an inner slide rail of the guide rack is intended for engaging one of the notches or for engaging the vertical slot, and that the pawl, when engaging one of the notches, inhibits displacement of an outer slide rail of the guide rack and holds the outer slide rail in a fixed vertical position, and that the pawl, when engaging the vertical slot, allows displacement of the outer slide rail and guides the outer slide rail vertically along the vertical slot.

Notches and a pawl engaging the notches provide a very effective and very safe solution for maintaining the guide rack in a selected more or less elevated position in relation to attachment means attaching the guide rack to a frame of a bed.

According to an embodiment of the guide rack of the invention, each of the guide racks are provided with a stop latch, the stop latch intended for keeping the pawl of the inner slide rail in engagement with one of the plurality of notches of the guide rack, and the stop latch having a lock position in relation to the pawl, in which lock position of the stop latch the pawl is prevented from disengaging from the notch, which the pawl is in engagement with, and the stop latch having a release position in relation to the pawl, in which release position of the stop latch the pawl is allowed to be disengaged from the notch, which the pawl is in engagement with.

A stop latch inhibiting the pawl from disengaging a notch provides an even safer solution for maintaining the guide rack in a selected more or less elevated position in relation to attachment means attaching the guide rack to a frame of a bed.

According to an embodiment of the invention, the connecting elements, in the situation of use, has an upper engagement means and a lower engagement means, the upper engagement means engaging an one suspending element and the lower engagement means engaging another suspension elements, the one suspension elements neighbouring the other suspension element, and the one suspension elements, in the situation of use, being above the other suspension element, and in that a distance between the upper engagement means and the lower engagement means of the brace defining a maximum extension between the one suspension elements and the neighbouring other suspension elements.

Engagement means between neighbouring suspension elements is a way to provide an elevation of a lower suspension element, and thus of a lower rod, when an upper suspension element, and thus an upper rod, is elevated. A maximum extension of the engagement means define a maximum distance between the lower and upper rod.

The object of the invention may also be obtained by a method for elevating a guard rail according to the invention from a lower position to an elevated position, the method comprising the following steps:

- a user applying an upright force on a top bar of the guard rail, the top bar thereby being elevated from a lower positon to an upper position towards a top position,
- during initial elevation of the top bar, a connection element, which is connected to the top bar and to a neighbouring lower bar, is extended or is displaced, between the top bar and the neighbouring lower bar,
- where extension or displacement of the connection element takes place, until the connection element is extended to a maximum extension of the connection element between the top bar and the neighbouring lower bar, and
- where the neighbouring lower bar, during subsequent elevation of the top bar, is elevated by the connection element transferring to the neighbouring lower bar the upright force, which the user applies to the top bar during elevation of the top bar.

The object of the invention may furthermore be obtained by a bed with a guard rail according to the invention, said guard rail being attached to a frame of the bed, and said guard rail extending along a side of the bed.

DESCRIPTION OF THE DRAWING

Hereafter, the invention will be described with reference to the drawing, where.

DETAILED DESCRIPTION OF THE INVENTION

Figure 1A:
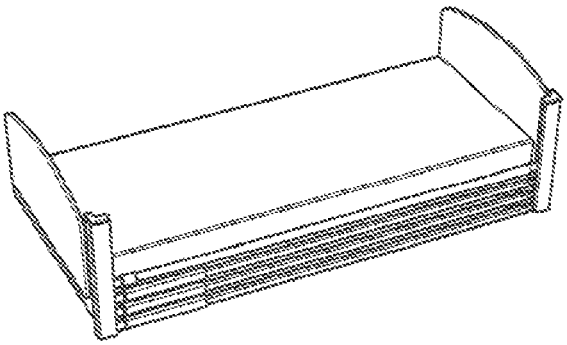
FIG. 1A-1D shows a guard rail according to the invention fixed to a frame of a bed of a hospital or nursery home.
Figure 1B:
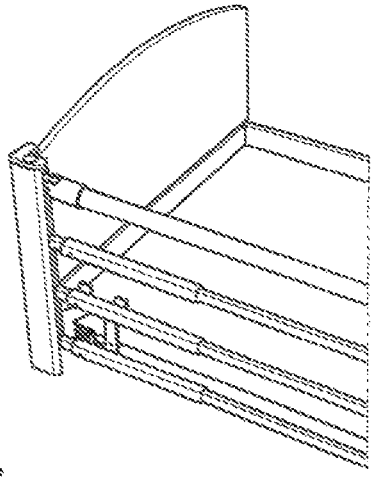
Figure 1C:
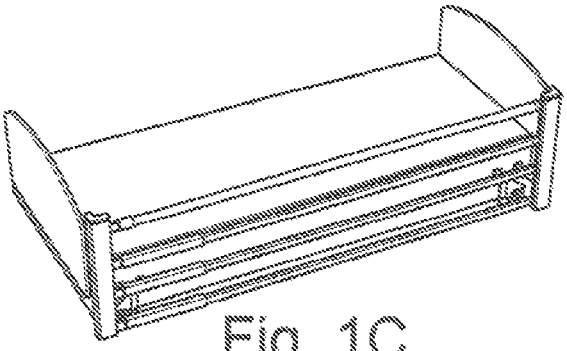
Figure 1D:
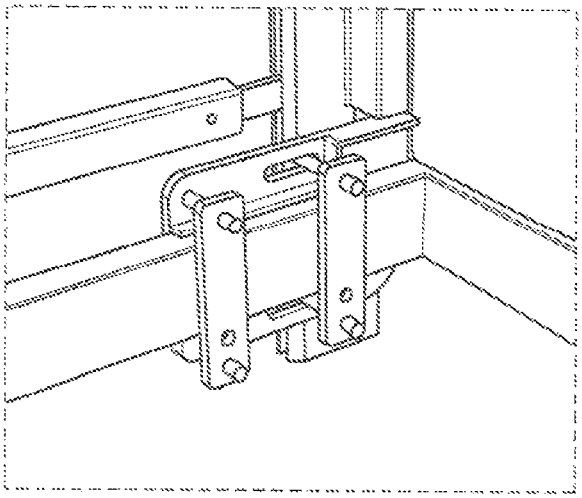

FIG. 1A-1D shows an embodiment of a guard rail, fixed to a frame of a bed, and with an top bar 1 (see also FIG. 2-4) and lower bars 2,3,4 (see also FIG. 2-4) of the guard rail in an uppermost position and a lowermost position. FIG. 1A shows the top bar 1 and lower bars 2,3,4 of the guard rail in a lowermost position, where a person can get out of bed and can get into bed. FIG. 1B shows the top bar 1 and the lower bars 2,3,4 of the guard rail in an uppermost position, where a person cannot get out of bed and cannot get into bed. FIG. 1C shows the top bar 1 and the lower bars 2,3,4 of the guard rail in the uppermost position, and where a mattress, for reasons of disclosure, is not shown. Attachment of the guard rail to a frame of the bed is established by an attachment bracket 8,9 (see also FIG. 2). FIG. 1D shows in more detail the attachment bracket 8,9, when attached to the frame of the bed.

Figure 2:
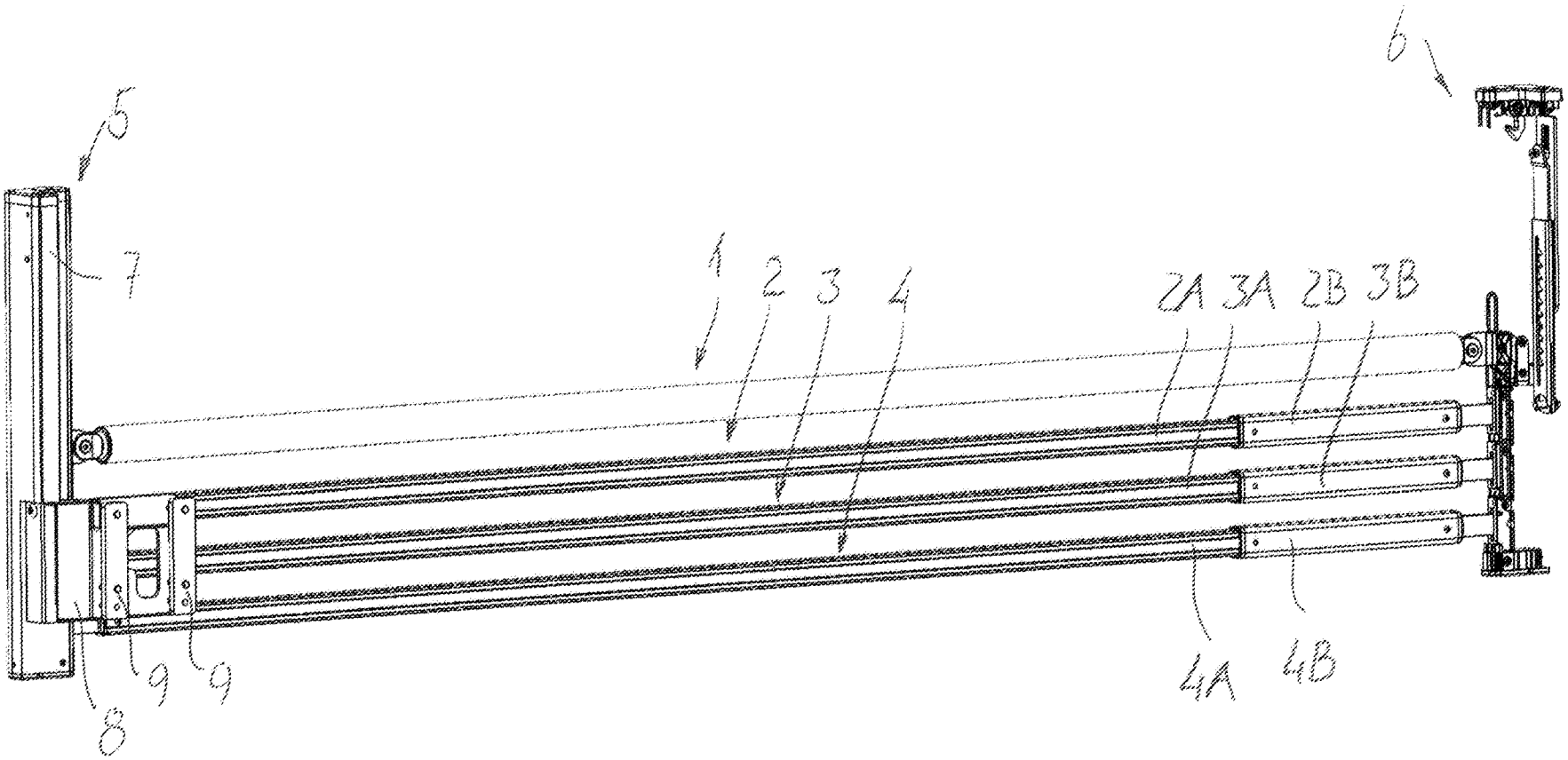
FIG. 2 shows, in an overall perspective view, an embodiment of a guard rail according to the invention.

FIG. 2 is a perspective view of a guard rail for a longitudinal side of a bed (see FIG. 1A-D). The guard rail comprises four bars extending along a longitudinal direction of the guard rail, a top bar 1 and three lower bars 2,3,4. More or fewer lower bars are possible, and other element instead of the lower bars, as example boards or plates are possible. The top bar 1 has a substantially circular cross-section. The top bar is intended for use with an auxiliary device in the form of a sheet to be rolled around the top bar, for turning a bedridden person lying in the bed, on the sheet as disclosed in EP 1 202 935 A1, the content of which is hereby incorporated by reference into the present patent application.

The auxiliary device for turning a bedridden person includes a horizontally arranged bar functioning as a roller, which is rotatably secured at each end in a rotatable bushing. The auxiliary device enables a sheet, which is fastened to the top bar, functioning as horizontal rollers at each side of a bed, to which the guard rail is mounted, to be pulled, when the roller is moved upwards, whereby a bed-ridden person lying on the sheet will be actuated to roll and thereby being turned. Compared with being handled by one or more nursing personnel, the sheet will apply a far more even load on the lying person, physically influencing the person far less than the load, which hands of nursing staff may exert on the lying person.

At each end of the guard rail, the guard rail is provided with guide racks 5,6. A left hand guide rack 5 is provided with a cover profile 7, which will be part of the guide rack in situations of use. Situations of use are situations, where the guard rail with the guide racks 5,6 is mounted to a bed at a hospital, a nursery or other facility, where bedridden persons are attended to, and where bedridden persons need to be inhibited from accidentally falling out of the bed and/or leaving the bed. A right hand guide rack 6 is, for the sake of disclosure, shown with the cover profile removed, in order to show a mechanism of the guide rack, normally covered by a cover profile in situations of use. Accordingly, a non-covered guide rack is not intended in situations of use, and is only to disclose and describe herein individual components of the guide rack, see also FIG. 3 and FIG. 4.

The lower bars 2,3,4 have a substantially rectangular cross-section. However, the lower bars may have any cross-sectional shape. The top bar 1 and the lower bars 2,3,4 are all telescopic. Telescoping of the top bar 1 is established by an inner bushing (not shown) of the top bar 1 displacing along the longitudinal extension of the top bar 1 in relation to an outer pipe 1A constituting most of the longitudinal extension of the top bar 1. Telescoping of the lower bars 2,3,4 is established by the lower bars 2,3,4 each constituted by one bar section 2A,3A,4A having a relatively smaller outer cross-sectional area. The one bar section 2A,3A,4A extends into another bar section 2B,3B,4B with an inner hollow. The inner hollow of the other bar section 2B,3B,4B has, relatively, a larger inner cross sectional area compared to the outer cross-sectional area of the one bar section 2A,3A,4A.

The bars 1,2,3,4 being telescopic provides the option of one end of the bars being raised or lowered at one end of the bed, as example at the right hand end of the bars, while the other end of the bars, as example the left hand end of the bars, is maintained in an already raised or lowered position. Thereby, nursing personnel may raise or lower one end of the guard rail firstly, and subsequently raise or lower the other end of the guard rail. The nursing personnel needs not raise or lower the entire guard rail, that is, both the left hand end and the right hand end of the bars, at the same time. A physical load on the nursing personnel, when handling the guard rail, is thereby limited.

An attachment element 8 is fixed to the cover profile 7. Other attachment elements 9 are connected to the one attachment element 8. The other attachment elements 9 are intended for being situated on one side of part of a frame of a bed (see FIG. 1D) and the one attachment element 8 is intended for being situated on an opposite side of the frame of the bed (see FIG. 1D). Forcing the one attachment element 8 and the other attachment elements 9 towards each other, when being situated at each side of the part of the frame of the bed, results in the one attachment element 8 and the other attachment elements 9 being secured to the frame of the bed, and results in the cover profile 7 at each end of the guard rail, and the guard rail as such, being secured to the frame of the bed.

Each of the bars 1,2,3,4, at each end of the bars, is attached to suspension elements 11,12,13,14 (see also FIG. 3 and FIG. 4) being individual to each of the bars. The ends of the bars are attached to the suspension elements along horizontal pins (see FIG. 3) enabling the end of the bars to pivot along a horizontal axis in relation to the suspension elements 11,12,13,14. The suspension elements, in the situation of use, are embedded in a track of the cover profile 7 (se FIG. 2). In the situation if use, the suspension elements 11,12,13,14 are displaceable vertically, along the track of the cover profile 7.

Figure 3:
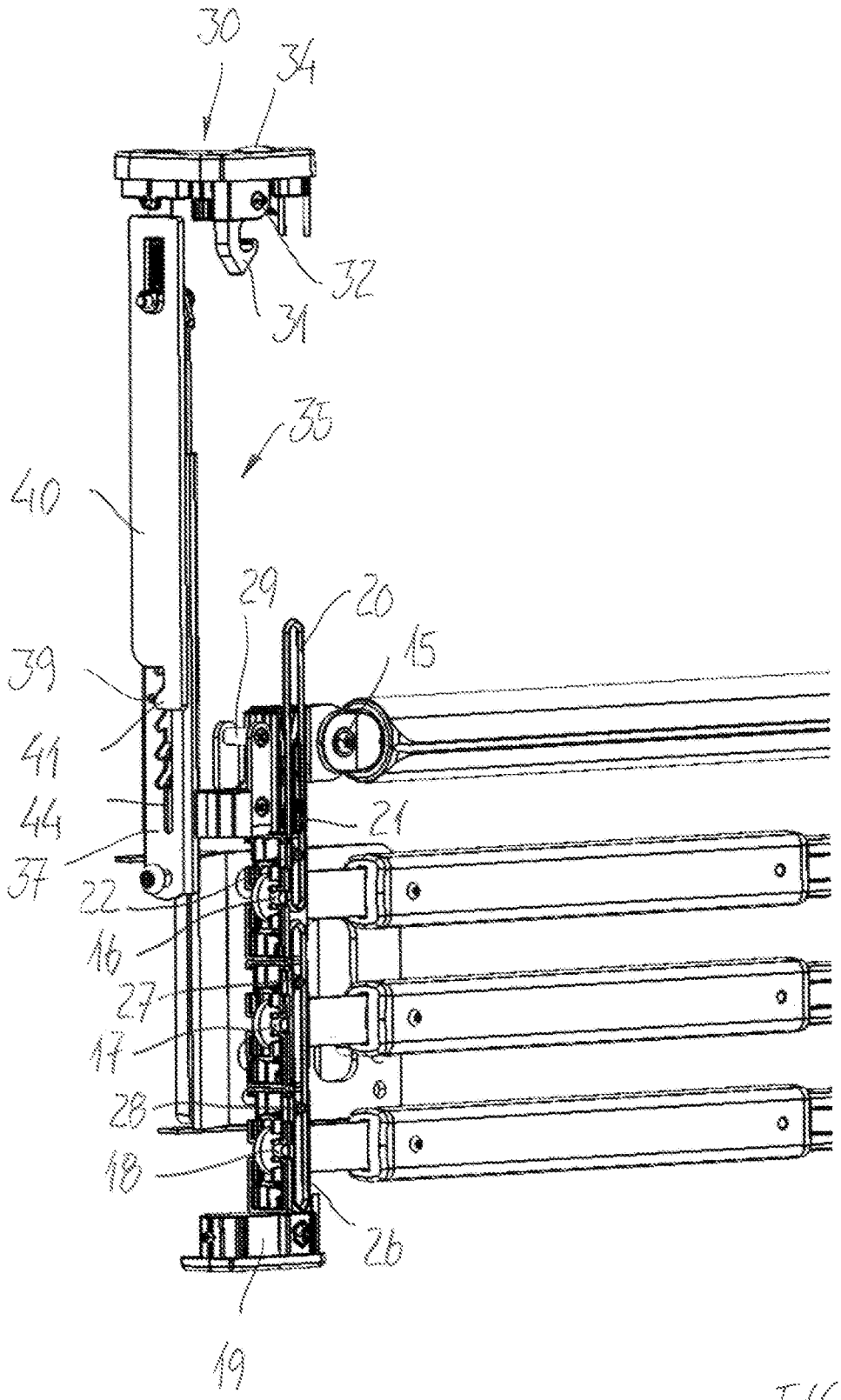
FIG. 3 shows, in a perspective view, selected details of the embodiment of a guard rail according to the invention.
Figure 4:
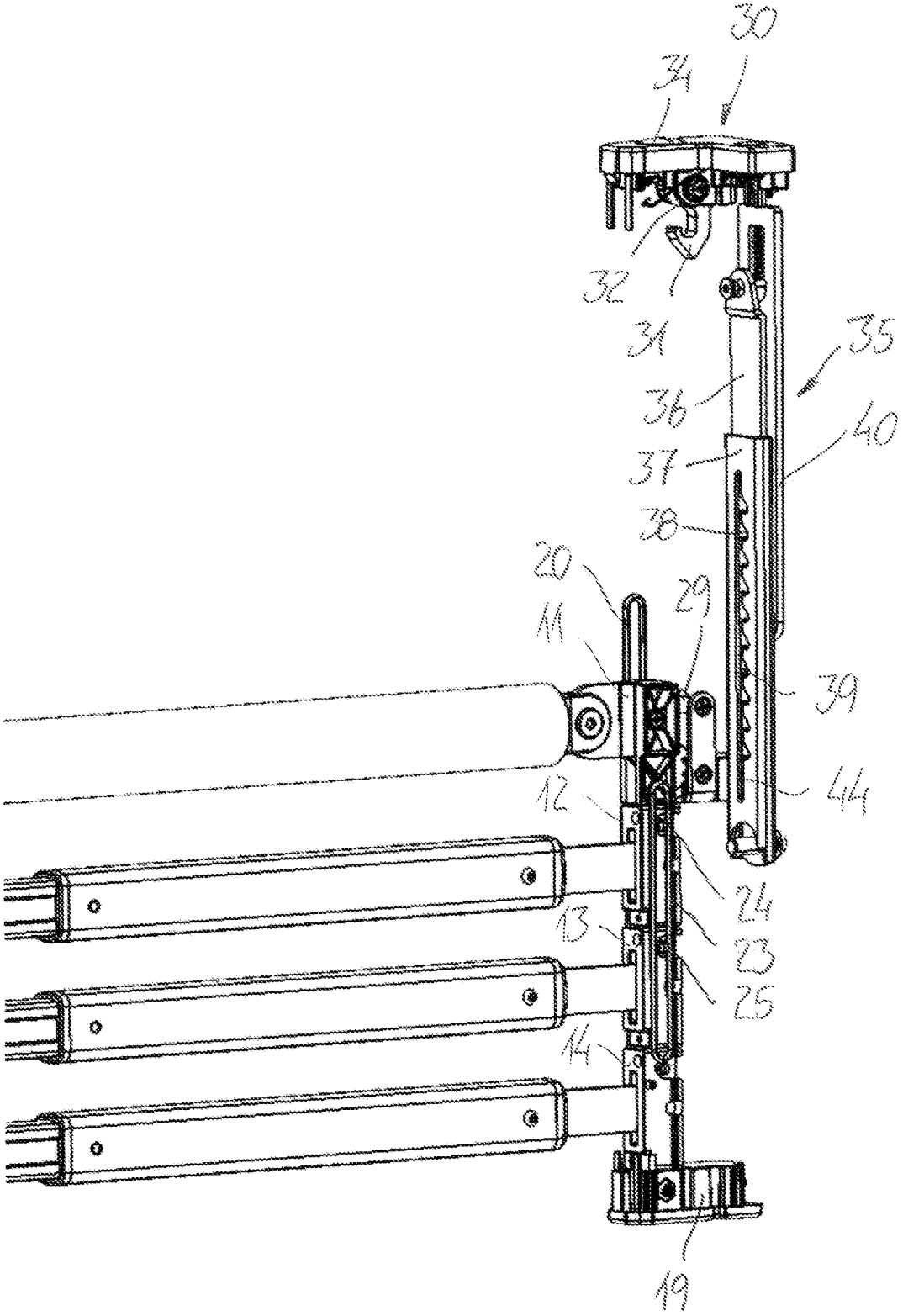
FIG. 4 shows, in a perspective view, other details of the embodiment of a guard rail according to the invention.

FIG. 3 and FIG. 4 show, amongst other features, that ends of the bars are connected to individual suspension elements 11,12,13,14 of the bars 1,2,3,4, respectively, via pins 15,16, 17,18. The pins allow the bars to pivot in relation to the suspension elements 11,12,13,14.

A bottom cap 19 is intended for being inserted into a bottom of the cover profile 7 and constitutes a stop for a lowermost suspension element 14 and thereby also a stop for the other suspension elements 11,12,13 situated above the lowermost suspension element 14.

FIG. 3 and FIG. 4 show braces connecting the suspension elements to each other.

FIG. 3 shows an upper brace 20 connecting the top suspension element 11 with a neighbouring lower suspension element, that is, suspension element denoted 12. The upper brace 20 embraces a protrusion 21 of the top suspension element and a protrusion 22 of the neighbouring lower suspension element denoted 12.

FIG. 4 shows a middle brace 23 connecting the suspension element denoted 12 with a neighbouring lower suspension element, that is, suspension element denoted 13. The middle brace 23 is positioned at an opposite side of the suspension elements 12,13 compared to the side of the suspension elements 12,13, at which the upper brace 20 (see FIG. 3) is positioned. The middle brace 23 embraces a protrusion 24 of the suspension element denoted 12 and a protrusion 25 of the suspension element denoted 13.

FIG. 3 also shows a lower brace 26 connecting the suspension element denoted 13 with a neighbouring lower suspension element, that is, the lowermost suspension element 14. The upper brace 20 connects suspension elements 11, 12 and the lower brace 26 connects suspension elements 13,14. The middle brace 23 is positioned on the opposite side of the suspension elements and connects elements 12, 13. The lower brace 26 embraces a protrusion 27 of the suspension element denoted 13 and a protrusion 28 of the suspension element denoted 14.

If and when the bars 1,2,3,4 of the guard rail is elevated from the lowermost position shown in FIG. 3 and FIG. 4 (see also FIG. 1A) to an uppermost position (see FIG. 1B and FIG. 1C), upper ends and lower ends of the braces 20, 23, 26 will engage the protrusions 21,22,24,25,27,28 of the suspension elements 11,12,13,14. Firstly, atop of the upper brace 20 will engage the protrusion denoted 21 of the top suspension element 11. Thereafter, a bottom of the upper brace 20 will engage the protrusion denoted 22 of the suspension element denoted 12. Thereafter, a top of the middle brace 23 will engage the protrusion denoted 24 of the suspension element denoted 12. Thereafter, a bottom of the middle brace 23 will engage the protrusion denoted 25 of the suspension element denoted 13. Thereafter, a top of the lower brace 26 will engage the protrusion denoted 27 of the suspension element denoted 13. Finally, a bottom of the lower brace 26 will engage the protrusion denoted 28 of the suspension element denoted 14. When all the bars 2,3,4 are in the uppermost position, the bars 2,3,4 will be locked in place by a piece of steel attached to the suspension element 14. Locking in place happens when the piece of steel attached to the suspension element 14 hits a socket screw attached inside the guide rail of the aluminum profile 7 (see FIG. 2), along which aluminum profile 7 the suspension elements is guided up and down.

Thereby, a user only elevating one end or both ends of the top bar 1, results in the one end or both ends the lower bars 2,3,4, sequentially, by the braces 20,23,26 and protrusions 21,22,24,25,27 automatically being elevated, too. A distance between the top and the bottom of the braces 20,23,26 defines a distance between the bars 1,2,3,4, when the top bar 1 is in the uppermost position (see FIG. 1B and FIG. 1C).

The top suspension element 11 has a pawl 29 intended for engaging a hook of a hook latch (see description below) to maintain the top bar 1 in an uppermost position (see FIG. 1B and FIG. 1C).

The guard rail comprises, as mentioned, a guide rack 5,6 at each end of the guard rail. FIG. 2 and FIG. 3 disclose in more detail features and elements of the guide rack.

The guide rack 5,6 comprises a top cap 30 intended for being inserted into a top of the cover profile 7. The top cap 30 supports a hook 31 pivotally connected to the top cap 30. The hook 31 extends downwards from the top cap 30. The hook 31 is capable of pivoting via a hook pivot pin 32 of the top cap 30. The hook 31 is intended for holding the top bar 1 at an uppermost position in relation to the guide rack. The pawl 29 of the top suspension element 11 is intended for engaging the hook 31, when the top bar 1 is elevated to the uppermost position. When the top bar 1 is elevated to the uppermost position, and during engagement between the pawl 29 and the hook 31, the pawl 29 engages the hook 31 by the hook 31 pivoting around the hook pivoting pin 32, thereby allowing the pawl 29 to engage the hook 31. The hook 31 is biased by a helical torsion spring 33 (see FIG. 5) to a position shown in FIG. 4 and FIG. 5. The hook 31, after engagement with the pawl 29, pivots back to a position, where the pawl 29 of the top suspension element 11 is inhibited from disengaging the hook 31. Only when the hook 31 is released, the pawl 29 is disengaging the hook 31 and the top bar 1 capable of being lowered. The pawl 29 may be released from the hook 31 by lifting the top bar 1 and afterwards pushing a push button 34.

The guide rack 5,6 also comprises an elongated slide 35 with an inner slide rail 36 and an outer slide rail 37. In a situation of use, the slide 35 extends vertically in tracks of a steel tube inside the cover profile 7 (see FIG. 5). The outer slide rail 37 is provided with a plurality of notches 38 (see also FIG. 3 and FIG. 4) along the extension of the outer slide rail 37. The notches 38 are slanted so that an open end of the notches is situated at an upper position and a closed end of the notches is situated at a lower position.

A pawl 39 of the inner slide rail 36 rests in one of the plurality of notches 38 of the outer slide rail 37. The notch, which the pawl 39 of the inner slide rail 37 is resting in, defines how far up or how far down the top cap 30 of the guide rack is raised or lowered in relation to the bed, which the guide rack is attached to. FIG. 3 shows the pawl 39 of the inner slide rail 37 resting in a somewhat middle positioned one of the plurality of notches 38. More notches are provided, positioned relatively higher and lower than the notch, which the pawl 39 is resting in.

A stop latch 40 constitutes part of the guide rack. The stop latch 40 is elongated and extends along the outer slide rail 36. The stop latch 40 has a protruding stop 41 at one end of the stop latch 40. In the position of the stop latch 40 shown in FIG. 3, the stop 41 of the stop latch 40 is abutting the pawl 39 and is inhibiting the pawl 39 in being displaced out of the notch 38. The stop latch 40 is intended for not allowing the pawl 39 to be released from the notch 38, before the stop latch 40 has been released from a position, where the stop 41 inhibits the pawl 39 from being released from the notch 38. Unintended release of the pawl 39 of the inner slide rail from the rest in the notch 38 is thereby avoided, and the top cap 30 of the guard rail is maintained in position.

Release of the stop latch 40, and subsequently allowing the pawl 39 of the inner slide rail 36 to displace from the rest in the notch 38, is described with reference to FIG. 5.

Figure 5:
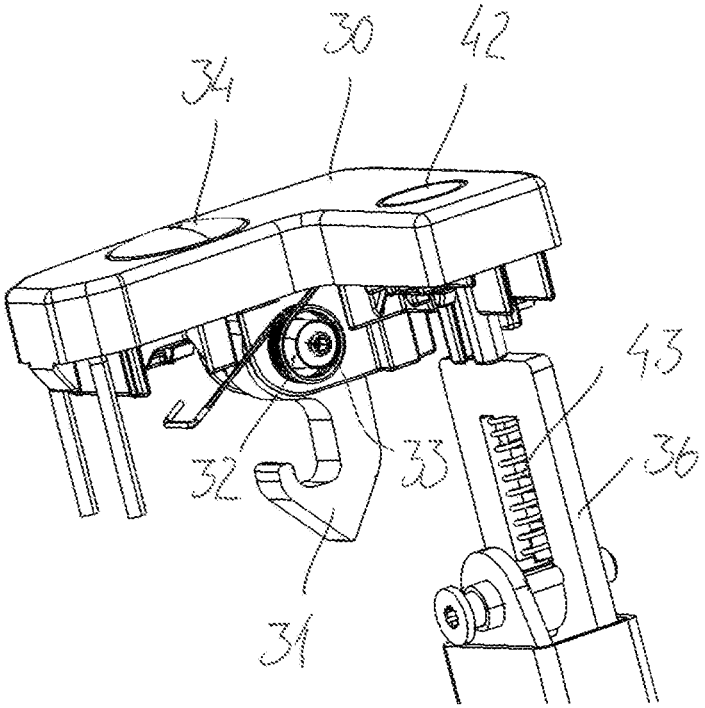
FIG. 5 shows, in a perspective view, even other details of the embodiment of a guard rail according to the invention.

FIG. 5 discloses two release mechanisms of the guide track 5,6 of the guard rail. A first release mechanism, part of which is disclosed in FIG. 3 and FIG. 4, is for maintaining and for releasing the top bar from an uppermost position. A second release mechanism, part of which is disclosed in FIG. 4, is for releasing the stop latch 40 (see FIG. 4), allowing the pawl of the inner slide rail being displaced from a notch.

The first release mechanism has a relatively large push button 34 (see also FIG. 3 and FIG. 4) embedded in the top cap 30 of the guide rack. The first release push button 34 is biased by a helical torsion spring 33 (see also FIG. 4) situated between the first release push button 34 and the hook 31 for holding the pawl 29 (see FIG. 4) of the top suspension element 11 in an uppermost position.

When the first release push button 34 is pushed down, the hook 31 for holding the pawl 29 of the top suspension element 11 in an uppermost position is released, and the pawl 29 of the top suspension element 11 is released. Subsequently, the top bar 1 and the lower bars 2,3,4 may be lowered to a lowermost position (see FIG. 1A, FIG. 3 and FIG. 4) along the guide rack. When the top bar 1 and the lower bars 2,3,4 are in the lowermost position along the guide rack, the top bar 1 is in a position at a level, or below a level, of a top surface of the mattress of the bed (see FIG. 1A).

Thus, when the top bar and the lower bars are in the lowermost position along the guide rack, a bedridden person is capable of getting out of bed or getting into bed and/or nursing personnel may handle the bedridden person, for any reason. When the top bar is in the uppermost position, the bedridden person is intentionally inhibited from getting out of bed. Also, when the top bar is in the uppermost position, the bed-ridden person is inhibited from accidentally falling out of the bed.

The second release mechanism has a relatively small push button 42 embedded in the top cap 30 of the guide rack. The second release push button 42 is biased by a helical compression spring 43 situated between a top of the stop latch 40 and a top of the inner slide rail 36. When the second release push button 42 is pushed down, the stop latch 40 is pushed downwards, and the stop 41 of the stop latch 40 is no longer inhibiting the pawl 39 of the inner slide rail in being displaced from the notch, in which the pawl is resting.

A user may, at the same time as pushing the second release push button 42, displace the top cap 30 a little upwards, so that the pawl 39 of the inner slide rail 36 is released from the notch 38, in which the pawl 39 is resting. When the user pulls the top cap 30 a little upwards, the pawl 39 is released from the notch 38. The pawl 39 is displaced to a vertical slot 44 extending along all the openings of the plurality of notches 38. The pawl 39 is now allowed being displaced all the way to a top of the vertical slot 44, or allowed being displaced all the way to a bottom of the vertical slot 44, or allowed being displaced upwards or downwards to any position along the vertical slot 44, between the top of the vertical slot 44 and the bottom of the vertical slot 44.

When the second release push button 42 is pushed, and the pawl 39 of the inner slide rail 36 is in a position along the vertical slot 44, the entire guide rack 35 may be displaced upwards or downwards. Displacing the guide rack 35 upwards or downwards is required to adjust a position of the guide rack 35 in relation to a frame of the bed, onto which frame the guard rail is attached (see FIG. 1A-FIG. 1D).

Different beds have different frames, and therefore, when attaching the guard rail to a frame of a bed, the guide racks 35 at each end of the guard rail will extend at different more or less elevated positions in relation to a frame of the bed, and in relation to a top surface of a mattress of the bed, depending on the frame of the bed.

If the frame of the bed is so designed, that the position, where the attachment elements 8,9 (se FIG. 1D and FIG. 2) are attached to the frame of the bed, is relatively low compared to a position of a top surface of a mattress of the bed, the pawl 39 of the inner slide rail 36 must be positioned in, and resting in, a notch 38 at a relatively high position along the outer slide rail 37 the guide rack 5,6. Thereby, the top bar 1 will, in an uppermost position, be sufficiently high positioned to avoid the bedridden person falling out of the bed, when the pawl 29 of the top suspension element 1 is engaged with the hook 31 at the top cap 30 of the guide rack 5,6. However, the uppermost position of the top bar 1 should be selected to still allow the bedridden person or allow nursery personal beside the bed being capable of reaching over the top bar 1.

On the contrary, if the frame of the bed is so designed, that the position, where the attachment elements 8,9 (se FIG. 1D and FIG. 2) are attached to the frame of the bed, is relatively high compared to a position of a top surface of a mattress of the bed, the pawl 39 of the inner slide rail 36 must be positioned in, and resting in, a notch 38 at a relatively low position along the outer slide rail 37 the guide rack 5,6. The top bar 1 must, in an uppermost position, still be sufficiently high positioned to avoid the bed-ridden person falling out of the bed, when the pawl 29 of the top suspension element 1 is engaged with the hook 31 at the top cap 30 of the guide rack 5,6. However, the uppermost position of the top bar 1 should still be selected to allow the bedridden person or allow nursery personal beside the bed reaching over the top bar 1.

By displacing the guide rack 5,6 upward or downwards, a position of the top bar, when being in an uppermost position, may be adjusted so that the top bar is in an uppermost position avoiding the bedridden person falling out of the bed, but still allowing the bedridden person or nursery personal beside the bed reaching over the top bar.

The guard rail of the invention may have additional features, which are supplement to the features described with reference to the figures and as disclosed in the figures.

A first additional feature is a sheet, extending between one top bar of one guard rail extending along one side of a bed and another top bar of another guard rail extending along at another side of a bed, and where at least one of the one top bar and the other top bar, respectively, has an actuator for displacing the sheet transverse to the sides of the bed, and where the actuator has a monitor for monitoring any displacement of the sheet transverse to the sides of the bed.

Monitoring any displacement of the sheet has the advantage of being capable of monitoring, without nursing staff being present, and possibly monitoring remotely, that a bedridden person lying on the sheet is rolled to one side or the other. Monitoring that a bedridden person lying on the sheet is rolled to one side or the other has the advantage of being capable of ensuring frequent rolling to one side or the other of the bed-ridden person, thereby possibly avoiding any bedsores, which the bedridden person otherwise may get, if the bedridden person is not frequently rolled to the one side or the other.

A second additional feature is a communication means for communicating to persons or data storage of any operation of the actuator of the top rod of the guard rail and/or of the guide rack, where the communication means is connected to sensors for sensing operation of the actor and/or for sensing operation of the first release mechanism of the guide rack as disclosed with reference to the figures.

Communicating any operation of the guard rail has the advantage of being capable of checking if, when end possibly how the guard rail is operated. Checking if, when end possibly how the guard rail is operated has the advantage of knowing if, when end possibly how a bedridden person is attended to, or knowing if, when end possibly how a bedridden person gets into bed and/or gets out of bed.

A third additional feature is a sheet, extending between one top bar of one guard rail extending along one side of a bed and another top bar of another guard rail extending along at another side of a bed, and where at least one of the one top bar and the other top bar, respectively, has an actuator for displacing the sheet transverse to the sides of the bed, and where the actuator has a monitor for monitoring an amperage applied to the actuator during displacement of the sheet transverse to the sides of the bed.

The amperage applied to the actuator multiplied with a standard voltage such as 12V or 24V gives the electrical power applied to the actuator. The more power applied to the actuator, the more load the actuator is capable of applying to the sheet. An amount of load applied to the sheet is dependent on the load of the bedridden person on the sheet. And the load of the bedridden person lying on the sheet is dependent on the weight of the person. Thus, monitoring the amperage applied to the actuator is an indication of the weight of the person lying on the sheet. Thereby, the weight of the parson may be established without a need for the person to be positioned on a scale.

A fourth additional feature is a top bar provide with a longitudinal slot extending along a generatrix of the top bar, where the longitudinal slot has an orifice and has a cavity, and where a largest cross-sectional dimension of the cavity, seen in plane perpendicular to the longitudinal extension, is larger than a smallest dimension of the orifice, seen in the plane perpendicular to the longitudinal extension.

A longitudinal slot extending along a generatrix of the top bar, and having a largest cavity dimension and a smallest orifice dimension as disclosed result in the sheet being capable of being secured to the top bar in an easy and safe manner. The sheet, along a longitudinal edge of the sheet, must have a specific cross-sectional dimension, seen in a plane perpendicular to the plane of the sheet, being between the largest cross-sectional dimension of the cavity and the smallest cross-sectional dimension of the orifice. Sliding the longitudinal edge of the sheet longitudinally along extension of the longitudinal slot result in that the specific cross-sectional dimension of the sheet is accommodated in the cavity, but at the same time, the specific cross-sectional dimension of the longitudinal edge of sheet is not capable of shifting out of the orifice.

LIST OF ELEMENTS

1 Top rod of guard rail
2 Lower rod of guard rail
3 Lower rod of guard rail
4 Lower rod of guard rail
5 Guide rack for guard rail
6 Guide rack for guard rail
7 Cover profile of guide rack
8 Attachment element of guide rack
9 Attachment element of guide rack
10-11 Top suspension element
12 Lower suspension element
13 Lower suspension element
14 Lower suspension element
15 Pivot pin of top suspension element
16 Pivot pin of lower suspension element
17 Pivot pin of lower suspension element
18 Pivot pin of lower suspension element
19 Bottom cap of guide rack
20 Upper brace
21 Protrusion of top suspension element
22 Protrusion of lower suspension element
23 Middle brace
24 Protrusion of lower suspension element
25 Protrusion of lower suspension element
26 Lower brace
27 Protrusion of lower suspension element
28 Protrusion of lower suspension element
29 Pawl of top suspension element
30 Top cap of guide rack
31 Hook of guide rack
32 Pivot pin of hook
33 Helical torsion spring
34 Push button for hook
35 Elongated slide of guide rack
36 Inner slide rail
37 Outer slide rail
38 Notches of outer slide rail
39 Pawl of inner slide rail
40 Stop latch of guide rack
41 Stop of stop latch
42 Push button for elongated slide
43 Helical compression spring
44 Vertical slot of inner guide rail

The invention claimed is:

1. A guard rail for a bed, the guard rail including:

a plurality of bars (1,2,3,4) intended for extending along a side of the bed, and which use has a top bar (1) and one or more lower bars (2,3,4), and where each of the plurality of bars has one end and another end, the one end facing one end of a bed and the other end facing another end of the bed, the other end of the bed being opposite to the one end of the bed;

two guide racks (5,6), which are arranged vertically and along opposing ends of the plurality of bars (1,2,3,4), the two guide racks (5,6) further including fastening means (8,9) for securing the two guide racks (5,6) to the bed;

where each end of the bars (1,2,3,4) is adapted for engaging a suspension element (11,12,13,14), individual for each of the bars (1,2,3,4), and each of the suspension elements (11,12,13,14) being attached to one of the guide racks (5,6), the guard rail wherein each of the two guide racks (5,6) has a hook (31) at a top cap (30) of the guide rack (5,6) and that a top suspension element (11) has a pawl (29), which pawl (29) engages the hook (31) of the guide rack (5,6) and that the top suspension element (11) is capable of being released from engagement with the hook (31), and in that the top suspension element (11) suspends an end of the top bar (1), and is connected to a neighbouring lower suspension element (12), which lower suspension element (12) suspends an end of a lower bar (2) neighbouring the top bar (1), and in that a connection between the top suspension element (11) and the neighbouring lower suspension element (12) is provided by a first connecting element (20) having a variable extension and a maximum extension between the top suspension element (11) and the neighbouring lower suspension element (12).

2. The guard rail according to claim 1, wherein a first lower suspension element (12) suspending an end of the first lower bar (2) is connected to a neighbouring second lower suspension element (13), which second lower suspension element suspends an end of a second lower bar (3) neighbouring an upper first lower bar (2), and in that a connection between the first lower suspension element (12) and the neighbouring second lower suspension element (13) is provided by a second connecting element (23) having a variable extension and a maximum extension between the first lower suspension element (12) and the neighbouring second lower suspension element (13).

3. The guard rail according to claim 1, wherein each of the bars (1,2,3,4) is telescopic along a longitudinal direction of the bars, so that a distance along a longitudinal direction of the bars is variable between the one end of each of the bars (1,2,3,4) and the other opposite end of each of the bars (1,2,3,4), so that each of the bars (1,2,3,4) may extend horizontally and non-horizontally, when one end of the bars (1,2,3,4) is displaced vertically along a guide rack (5,6) and another end of the bars (1,2,3,4), at the same time, is not displaced vertically along a guide rack (5,6).

4. The guard rail according to claim 3, wherein each of opposite ends of the top bar (1) and the lower bars (2,3,4) are attached to a suspension element (11,12,13,14) via a pivot pin (15,16,17), and that each end of the bars (1,2,3,4), where the guard rail is attached to a frame of a bed, is pivotable around a substantially horizontal axis along the pivot pin (15,16,17,18).

5. A guide rack (5,6) for the guard rail according to claim 1, wherein the guide rack (5,6) is provided with a plurality of notches (38) extending, in a situation of use, along a vertical direction, and in that the guide rack (5,6) is provided with a vertical slot (44), and that each of the notches (38) has a bottom of the notch and an opening of the notch, and that the opening of each of the notches (38) communicates with the vertical slot (44), and that a pawl (39) of an inner slide rail (36) of the guide rack (5,6) is intended for engaging one of the notches (38) or for engaging the vertical slot (44), and that the pawl (39), when engaging one of the notches (38), inhibits displacement of an inner slide rail (36) in relation to an outer slide rail (37) and holds the inner slide rail (36) in a fixed vertical position in relation to the outer slide rail (37), and that the pawl (39), when engaging the vertical slot (44), allows displacement of the inner slide rail (36) in relation to the outer slide rail (37) and that the pawl (39) guides the inner slide rail (36) vertically along the vertical slot (44) of the outer slide rail (37).

6. The guide rack according to claim 5, wherein each of the guide racks (5,6) are provided with a stop latch (40), and that the stop latch (40) is intended for keeping the pawl (39) of the inner slide rail (36) in engagement with one of the plurality of notches (38) of the outer slide rail (37), and that the stop latch (49) has a lock position in relation to the pawl (39), in which lock position of the stop latch (40) the pawl (39) is prevented from disengaging from the notch (38), which the pawl is in engagement with, and that the stop latch (40) has a release position in relation to the pawl (39), in which release position of the stop latch (40) the pawl (39) is allowed to disengage from the notch (38), which the pawl (39) is in engagement with.

7. The guide rack according to claim 5, wherein a connecting element has an upper engagement means and a lower engagement means, the upper engagement means engaging one suspending element and the lower engagement means engaging another suspension elements, the one suspension elements neighbouring the other suspension element, and the one suspension elements being above the other suspension element, and in that a distance between the upper engagement means and the lower engagement means of the brace defining a maximum extension between the one suspension elements and the neighbouring other suspension elements.

8. A method for elevating the guard rail according to claim 1 from a lower position to an elevated position, the method comprising the following steps:

a user applying an upright force on a top bar of the guard rail, the top bar thereby being elevated from a lower position to an upper position towards a top position, during initial elevation of the top bar, a connection element, which is connected to the top bar and to a neighbouring lower bar, is extended or is displaced, between the top bar and the neighbouring lower bar, where extension or displacement of the connection element takes place, until the connection element is extended to a maximum extension of the connection element between the top bar and the neighbouring lower bar, and where the neighbouring lower bar, during subsequent elevation of the top bar, is elevated by the connection element transferring to the neighbouring lower bar the upright force, which the user applies to the top bar during elevation of the top bar.

9. A bed with the guard rail according to claim 1, said guard rail being attached to a frame of the bed, and said guard rail extending along a side of the bed.

* * * * *